US007406728B2

(12) United States Patent
VanNeste

(10) Patent No.: US 7,406,728 B2
(45) Date of Patent: Aug. 5, 2008

(54) THREE-SECTION BLANKET SET

(76) Inventor: Helen Stacia VanNeste, 428 Royal Tern Dr., Hampstead, NC (US) 28443

( * ) Notice: Subject to any disclaimer, the term of this patent is extended or adjusted under 35 U.S.C. 154(b) by 5 days.

(21) Appl. No.: 11/729,152

(22) Filed: Mar. 28, 2007

(65) Prior Publication Data

US 2007/0226905 A1 Oct. 4, 2007

Related U.S. Application Data

(60) Provisional application No. 60/764,601, filed on Mar. 31, 2006, provisional application No. 60/851,240, filed on Oct. 13, 2006.

(51) Int. Cl.
*A47G 9/04* (2006.01)

(52) U.S. Cl. ..... 5/486; 5/482; 24/72.5

(58) Field of Classification Search ..... 5/486, 5/482, 496, 498, 502, 420, 717; 24/72.5
See application file for complete search history.

(56) References Cited

U.S. PATENT DOCUMENTS

| | | | | |
|---|---|---|---|---|
| 3,072,776 | A | | 1/1963 | Quenneville |
| 3,331,088 | A | | 7/1967 | Marquette |
| 3,508,284 | A | | 4/1970 | Marquette |
| 3,508,285 | A | | 4/1970 | Marquette |
| 3,530,516 | A | | 9/1970 | Marquette |
| 4,005,499 | A | | 2/1977 | Klein |
| 4,631,765 | A | * | 12/1986 | Casey ..... 5/417 |
| 4,878,258 | A | * | 11/1989 | Casey ..... 5/420 |
| 5,199,121 | A | | 4/1993 | Payne |
| 5,251,350 | A | * | 10/1993 | Bordenave et al. ..... 5/482 |
| 5,287,573 | A | | 2/1994 | Ritacco |
| 5,708,995 | A | | 1/1998 | Wu et al. |
| 5,713,089 | A | * | 2/1998 | Ferrante ..... 5/502 |
| 5,887,299 | A | * | 3/1999 | Phillips ..... 5/413 R |
| 6,237,171 | B1 | | 5/2001 | Allen |
| 6,311,347 | B1 | | 11/2001 | Limardi et al. |
| 6,643,872 | B1 | | 11/2003 | Buswell |
| 6,698,043 | B2 | | 3/2004 | Fabian |
| 6,862,760 | B2 | | 3/2005 | Bradley et al. |
| 7,124,455 | B2 | | 10/2006 | Demarco et al. |

* cited by examiner

*Primary Examiner*—Alexander Grosz
(74) *Attorney, Agent, or Firm*—MacCord Mason PLLC

(57) ABSTRACT

A three-panel blanket set is described in which any two panels are releasably attachable to form a complete blanket. The first panel has a first insulation value and a first fastener section on its lower surface extending along the right side edge. The second panel has a second insulation value, a second fastener section on the upper surface extending along the left side edge, and a third fastener section on the lower surface extending along the right side edge. The third panel with a third insulation value has a fourth fastener section on the upper surface extending along the left side edge. The panel insulation values are different from each other. The first fastener section is releasably attachable to the second fastener section or to the fourth fastener section, and the fourth fastener section is releasably attachable to the first fastener section or to the third fastener section.

14 Claims, 2 Drawing Sheets

THREE-SECTION BLANKET SET

This application claims the benefit of U.S. Provisional Application Ser. No. 60/764,601, filed Mar. 31, 2006, and U.S. Provisional Application Ser. No. 60/851,240, filed Oct. 13, 2006.

BACKGROUND OF THE INVENTION (1) Field of the Invention

The present invention relates to blankets with sections of different insulation properties, and in particular to blanket sets that include three panels configured so that selected pairs of the three panels can be joined to create a blanket with panels or sections with different insulation properties.

(2) Description of the Prior Art

When two occupants sleep in the same bed, it is often the case that the warmth requirement for one individual will be different from the other. That is, one individual may require a covering of a given insulation value, while the other individual may require a covering having a relatively lighter or heavier insulation value.

Various attempts to resolve this problem have been described in the prior art. Instead of using a blanket having a uniform thermal resistance or insulation value, the prior art discloses blankets comprised of first and second panels, each having a length equal to that of the desired complete blanket and a width approximately equal to one-half of the desired width of the blanket, with some means being provided to releasably attach the panels together at their inner edges to form the complete blanket. When used, the panel with the lesser insulation value is positioned over the side of the bed to be occupied by the person with the lesser warmth requirement, while the panel with the greater insulation value is positioned over the side of the bed to be occupied by the person with the greater warmth requirement. The adjacent edges of the two panels may be permanently attached by sewing, or releasably attached with a zipper, hook-and-loop fastener, button, ties, etc.

The prior art, i.e., U.S. Pat. No. 6,862,760 to Bradley et al., also broadly describes a three section comforter, i.e., two fabric sheets with insulation disposed between the sheets, that can be comprised of two selected sections that have releasable fasteners attached to both sides of each comforter section, with the fasteners preferably being identical and attached by an intermediate fastener, e.g., double buttons. However, Bradley et al. fail to describe a system specifically suitable for use with blankets. Therefore, there remains a need for a blanket set of three or more panels, constructed so that a selected pair of the panels can be easily and releasably attached by a zipper or other attachment means. There is also a need for a unique attachment means especially suited for use in attaching two blanket panels.

SUMMARY OF THE INVENTION

Generally, the present invention is comprised of a three-panel blanket set, with each panel having an insulation value different from that of the other two panels, a length equal to the length of the complete blanket, a width approximately equal to one-half the width of the complete blanket, opposed upper and lower surfaces, opposed top and bottom edges, and opposed left and right side edges.

A first panel of the set, e.g., a light weight blanket fabric, has a first insulation value, and a first fastener section that is attached to the lower surface of the panel extending along the right side edge. A second panel, e.g., a medium weight blanket fabric, has a second insulation value, i.e., a second fastener section on the upper surface of the panel extending along the left side edge, and a third fastener section on the lower surface of the panel extending along the right side edge. A third panel, e.g., a heavy weight blanket fabric, has a third insulation value and a fourth fastener section on the upper surface of the panel extending along the left side edge. The insulation value of each panel is different from the insulation values of the other two panels.

In a preferred embodiment, the blanket set first side panel has a light insulation value relative to the other two panels, and a first fastener section that is attached to the lower surface of the panel extending along the panel's inner or right side edge. The second panel has a medium insulation value relative to the other two panels, a second fastener section on the upper surface of the panel extending along the left side edge, and a third fastener section on the lower surface of the panel extending along the right side edge. The other, e.g., third, side panel has a heavy insulation value relative to the other two panels, and a fourth fastener section on the upper surface of the panel extending along the left side edge.

The side edges of the two side panels, i.e., numbers one and two described above, opposite the edges with fastener sections are preferably free of fastener sections, and are also preferably bound. The top and bottom edges of each panel may also be bound. One or more of the bound edges may include indicia to display the relative insulation value of the panel, e.g., the upper and/or lower edge may be covered with trim that is printed with "Light", "Medium" or "Heavy", or other indicia of the panel's insulation value.

The fastener sections are constructed so that the first fastener section can be releasably attached to the second fastener section or to the fourth fastener section, and the fourth fastener section can be releasably attached to the first fastener section or to the third fastener section. Thus, any two of the panels can be joined together to form a complete blanket.

Flaps of blanket material may extend over the fastener sections on the panel edges with fastener sections adjacent both side edges, e.g., panel number two as described above, to hide the fastener section when the section is not used in attaching the panel to another panel. Flaps are not required for the fastener sections on the panels with a single fastener section, e.g., panels one and three as described above, since those sections will be covered by another panel when used.

In one embodiment of the invention, the fastener sections are sections of a zipper that can be zipped together to join the two panels. One of the zipper sections of each attachable pair will include the slider and pull tab. In order for the first panel to be attachable to either the second or third panel and for the second panel to also be attachable to the third panel, the zipper sections with the slider and pull tab should be located on the same surfaces of the blanket panels, e.g., the upper sides, while the zipper sections without the slider and pull tab will be located on the opposite surface, e.g., the lower surface of the panels.

In another embodiment of the invention, the panels are joined by a unique fastener which provides greater ease of attachment and flexibility of the blanket during use. This unique fastener is comprised of a first section, herein referred to as the female section, in the shape of a hollow cylindrical, slitted sheath attached adjacent the edge of one panel, and a second section, referred to herein as the male section, in the shape of an elongated cylindrical rod that is attached adjacent the edge of another panel.

For example, the female sections may be the first and third sections as described above, while the male sections may be the second and fourth sections as described above. The sections are attached to the blanket panel with a plastic or fabric web strip, e.g., by sewing, to the blanket panel, or fused into the fabric.

When using this rod and sheath fastener, the end of the rod at one end of the panel, e.g., the top end, is inserted into the end of the sheath at the opposite end of another panel, e.g., the bottom end. The rod is then drawn through the sheath until the adjacent edges of the panels are coextensive. The rod web extends outwardly from the sheath through the slit.

As noted previously, the fastener sections are preferably spaced inwardly a short distance, e.g., at least the width of the fastener section, or about 1", from the edge of the blanket. Thus, when the panels are joined together, the blanket panel edges overlap to hide the fasteners. The preferred blanket sizes are: full size=86"×93"; queen size=96"×93"; and king size=116"×93".

The panels can be inverted so that the upper surfaces as described above become the lower surface, and the lower surfaces as described above become the upper surfaces. However, for purposes of the description, the panels should be oriented in the same manner for assembly, i.e., with both panels having the first surface as the upper surface. Thus, it will be understood that the references to upper and lower surfaces, and to left and right edges, are for purposes of description of the relationships of the panels to each other and are not a limitation of the structure of the invention.

DETAILED DESCRIPTION OF THE INVENTION

In the following description, terms such as horizontal, upright, vertical, upper, lower, left, right, above, below, beneath, and the like, are used solely for the purpose of clarity in illustrating the invention, and should not be taken as words of limitation. The drawings are for the purpose of illustrating the invention and are not intended to be to scale.

Figure 1:
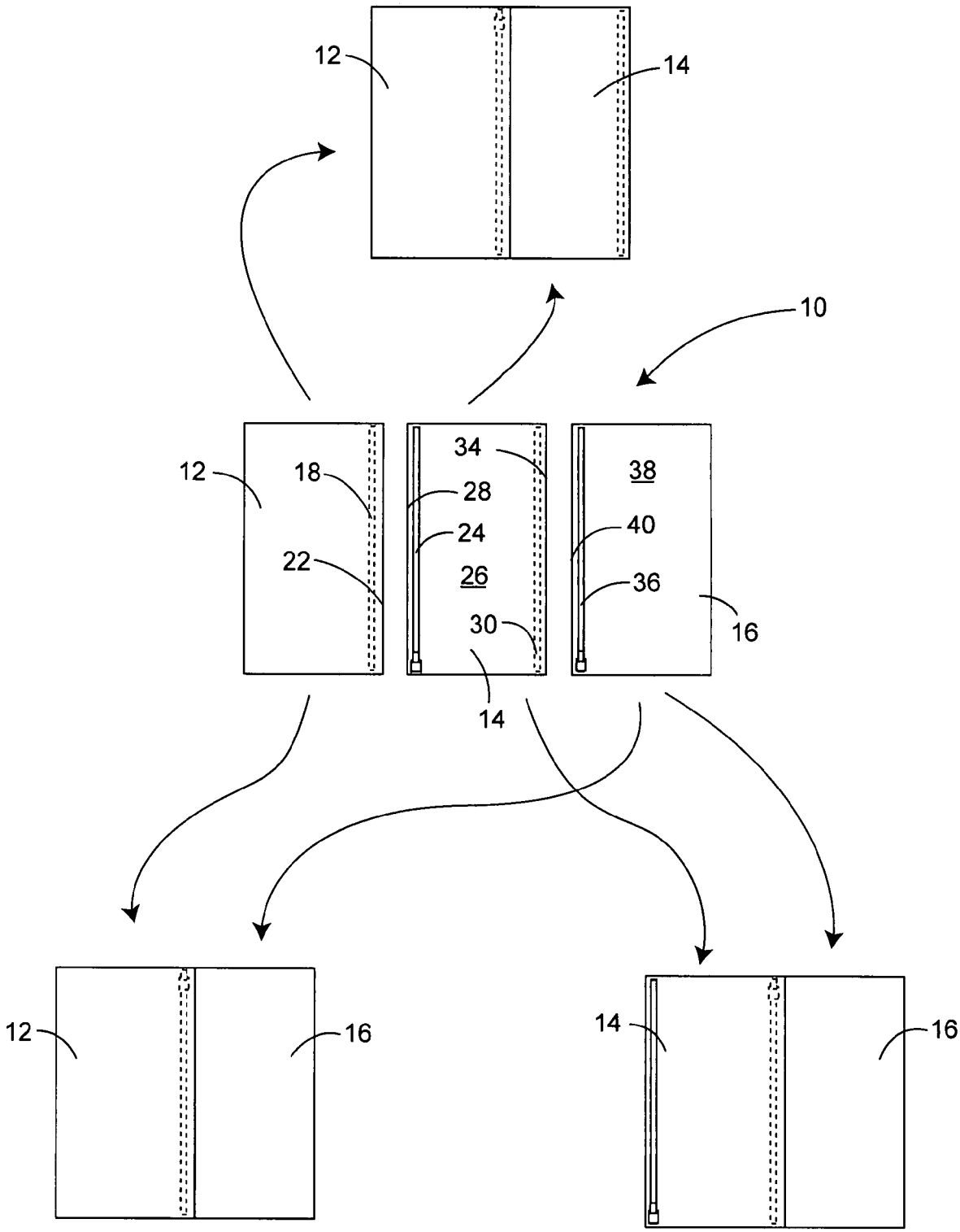
FIG. 1 is a top view of the three panels illustrating how they can be selectively joined to form completed blankets.
Figure 2:
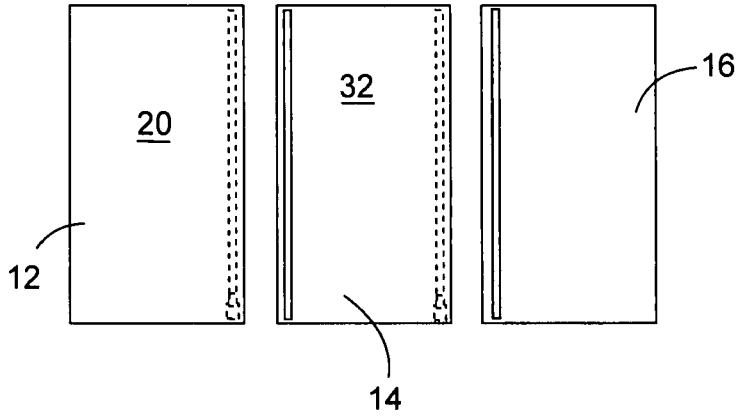
FIG. 2 is a bottom view of the three panels.

As illustrated in the FIGS. 1 and 2, one preferred blanket set, generally 10, is comprised of a first panel 12, a second panel 14 and a third panel 16. Panel 12, include a first zipper section 18 attached, e.g., by sewing, to the lower surface 20 of panel 12 along inner side edge 22. Panel 14 includes a second zipper section 24 on the upper surface 26 of panel 14 extending along side edge 28, and a third zipper section 30 on the lower surface 32 of panel 14 extending along opposed side edge 34. Panel 16 includes fourth zipper section 36 on the upper surface 38 of panel 16 extending along side edge 40. As illustrated, complete blankets can be formed by combining panels 12/14, 12/16 or 14/16.

Figure 3:
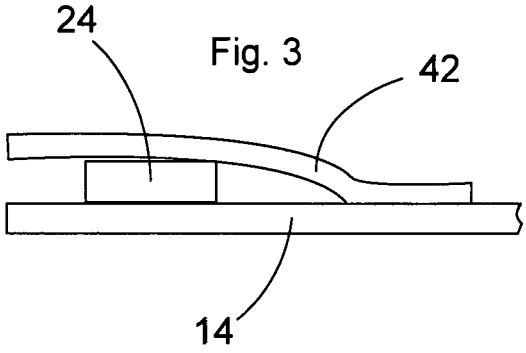
FIG. 3 is a detailed end view of the edge of the panel with two zipper sections showing hiding of one zipper section with a flap of blanket material.

As illustrated in FIG. 3, a flap of blanket material 42 can extend over zipper section 24 on panel 14 to hide zipper section 24 when zipper section 24 is not attached to another zipper section. A similar flap can extend over zipper section 30. These flaps are not required for zipper sections 18 and 36, which will be covered by another panel when used.

Edges of panels 12, 14 and 16 that do not include an attached zipper section are bound to prevent raveling. In addition, trim 44 is sewn over the upper and lower ends of the panels. Trim 44 on one of the ends of each panel can include indicia 46 to aid in orientation of the panels, as illustrated in FIG. 3. As illustrated, complete blankets can be formed by combining panels 12/14, 12/16 or 14/16.

Figure 4:
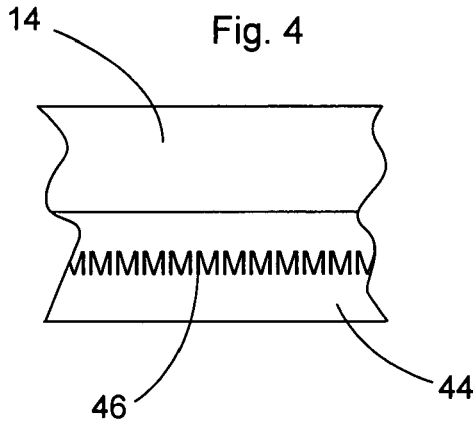
FIG. 4 is a detailed top view of a part of the blanket panel trim showing the indicia.
Figure 5:
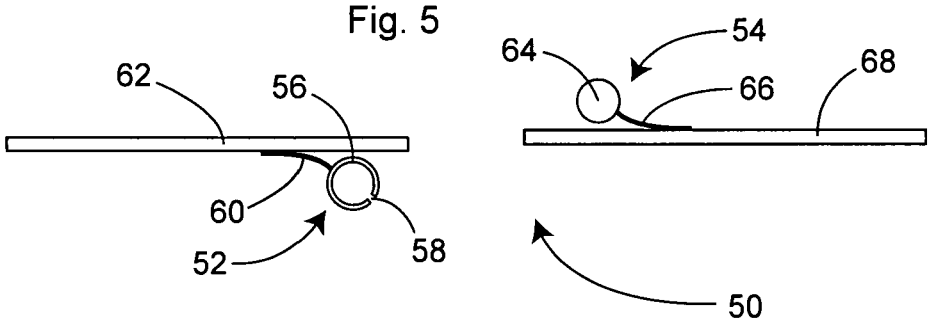
FIG. 5 is an end view of two blanket panels with cylinder and rod connectors.
Figure 6:
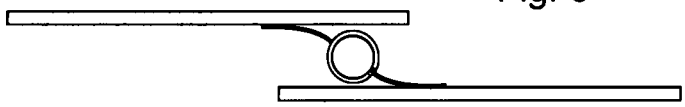
FIG. 6 is an end view of the cylinder and rod connectors attached.

FIGS. 4 and 5 illustrate an alternative fastener, generally 50, comprised of a female fastener section 52 and a male fastener section 54. Section 52 is comprised of an elongated cylinder 56 with a longitudinal slit 58 on one side of cylinder 56 and an attachment web 60 on the opposite side of cylinder 56 for attachment to the lower surface of a blanket panel 62 along a side edge. Section 54 is comprised of a cylindrical rod 64 having outer dimensions corresponding to the inner dimensions of cylinder 56, and a longitudinal web 66 extending radially outwardly from rod 64 for attachment to the upper side of another panel 68 adjacent a side edge. Fastener 50 is enlarged for ease of illustration.

When using fastener 50 to attach two panels, one end of rod 64 is inserted into one end of cylinder 56, with rod web 66 extending outwardly through cylinder slit 58. Rod 64 is then slid into cylinder 56 until rod 64 is coextensive with cylinder 56. The resultant connection of the two panels is secure, while still providing the flexibility required during use of the blanket. This fastener, while described in the context of joining two panels of a three panel blanket set also finds utility in joining two panels of a two panel blanket set. The blanket connectors can also be fused into the fabric.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A three-panel blanket set, any two panels being releasably attachable to form a blanket, each panel having a length equal to the length of the blanket, a width approximately equal to one-half the width of the blanket, opposed first and second surfaces, opposed top and bottom edges, and opposed first and second side edges, said set comprising:

a) a first panel with a first insulation value and a first and sole fastener section, on the second surface of said panel extending along said second side edge;

b) a second panel with a second insulation value, a second fastener section on the first surface of said panel extending along said first side edge, and a third fastener section on the second surface of said panel extending along said second side edge; and c) a third panel with a third insulation value and a fourth and sole fastener section, on the first surface of said panel extending along said first side edge, said first, second and third insulation values being different from each other, said first fastener section being releasably attachable to said second fastener section or to said fourth fastener section, and said fourth fastener section being releasably attachable to said first fastener section or to said third fastener section.

2. The set of claim 1, wherein said first and second surfaces are upper and lower surfaces, and said first and second side edges are left and right side edges.

3. The set of claim 1, wherein the edges of said panels overlap when two fastener sections are attached to conceal said fastener sections.

4. The set of claim 1, wherein the fastener sections on the second panel are covered by flaps of blanket material.

5. The set of claim 1, wherein said second panel has a greater insulation value than said first panel and said third panel has a greater insulation value than said second panel.

6. The set of claim 1, wherein each of said panels includes indicia along its top or bottom edge showing the relative insulation value of the panel.

7. The set of claim 1, wherein each fastener section is spaced approximately one-inch from a side edge of the blanket panel to which the fastener section is attached.

8. The set of claim 1, wherein said first and third fastener sections are different from said second and fourth fastener sections.

9. A three-panel blanket set, any two panels being releasably attachable to form a blanket, each panel having a length equal to the length of the blanket, a width approximately equal to one-half the width of the blanket, opposed first and second surfaces, opposed top and bottom edges, and opposed first and second side edges, said set comprising:

a) a first panel with a light insulation value relative to the insulation values of the other two panels and a first zipper section on the second surface of said panel extending along said second side edge; said first zipper section being the sole fastener on said first panel, b) a second panel with medium insulation value relative to the insulation values of the other two panels, a second zipper section on the first surface of said panel extending along said first side edge, and a third zipper section on the second surface of said panel extending along said second side edge; and c) a third panel with heavy insulation value relative to the insulation values of the other two panels, and a fourth zipper section on the first surface of said panel extending along said first side edge said fourth zipper section being the sole fastener on said third panel, said first and third zipper section including sliders and tabs, and said second and fourth zipper sections being without sliders and tabs.

10. The set of claim 9, wherein said first and second surfaces are upper and lower surfaces, and said first and second side edges are left and right side edges.

11. The set of claim 9, wherein the edges of said panels overlap when two fastener sections are attached to conceal said fastener sections.

12. The set of claim 9, wherein each of said panels includes indicia to identify the relative insulation value of the panel.

13. The set of claim 9, wherein each zipper section is spaced approximately one-inch from a side edge of the blanket panel to which the fastener section is attached.

14. The set of claim 9, wherein two of the panels are side panels with only one fastener section, and one panel is a center panel with two fastener sections, the fastener sections of said center panel being covered by flaps of blanket material.

* * * * *